United States Patent [19]

Kakinuma

[11] Patent Number: 4,747,276

[45] Date of Patent: May 31, 1988

[54] HELIUM COMPRESSOR APPARATUS

[75] Inventor: Masami Kakinuma, Chiba, Japan

[73] Assignee: Seiko Seiki Kabushiki Kaisha, Chiba, Japan

[21] Appl. No.: 36,119

[22] Filed: Apr. 9, 1987

[30] Foreign Application Priority Data

Apr. 15, 1986 [JP] Japan ..... 61-86568

[51] Int. Cl.[4] ..... F25B 31/00

[52] U.S. Cl. ..... 62/505

[58] Field of Search ..... 62/505

[56] References Cited

U.S. PATENT DOCUMENTS

| | | | |
|---|---|---|---|
| 3,158,009 | 11/1964 | Rayner | 62/505 |
| 3,416,330 | 12/1968 | Weller et al. | 62/505 |
| 3,805,547 | 4/1974 | Eber | 62/505 |
| 3,838,581 | 10/1974 | Endress | 62/505 |
| 4,020,642 | 5/1977 | Haselden et al. | 62/505 |
| 4,182,137 | 1/1980 | Erth | 62/505 |

*Primary Examiner*—Ronald C. Capossela

*Attorney, Agent, or Firm*—Bruce L. Adams; Van C. Wilks

[57] ABSTRACT

A helium compressor apparatus wherein a compressor and a motor driving the compressor are disposed in a hermetically-sealed casing and helium gas is used as a refrigerant. The helium compressor apparatus of the invention comprises a separate cooling system attached to the compressor apparatus which forcibly cools down a part of the high-pressure gas discharged outside the casing by the compressor. The cooled down portion of the gas is reintroduced into the casing to cool down the compressor and the motor effectively and to thereby lengthen the life of the helium compressor apparatus.

12 Claims, 1 Drawing Sheet

HELIUM COMPRESSOR APPARATUS

BACKGROUND OF THE INVENTION

This invention relates to a helium compressor, and particularly to a helium compressor provided with an attached cooling system which can efficiently cool down a compressor and a driving motor installed in a casing.

In a helium compressor apparatus using helium gas as a refrigerant gas, generally, a large heat is generated from the compressor in its operation and the compressor is put in a state of high temperature, because the adiabatic coefficient of the helium gas is as great as $K=1.66$. In addition, the motor driving this compressor is also put in a state of high temperature with its driving rotation, and thus a state of considerably high temperature is caused in a hermetically-sealed casing.

To cope with this state, a cooling system as shown in FIG. 2 is usually employed.

In FIG. 2, a compressor 2 and a motor 3 driving this compressor 2 are disposed in a hermetically-sealed casing 1, and a low-pressure gas inside the hermetically-sealed casing 1 is sucked in and compressed by the compressor 2, and then it is discharged as a high-pressure gas outside the casing 1 through a discharge port 4. The discharged high-pressure gas passes through an expansion unit 5 and thereafter it is collected again into the hermetically-sealed casing 1 through a suction port 6.

In order to cool down the compressor 2 and the motor 3 disposed in hermetically-sealed casing 1, a cooling pipe 7 is wound around and along the outer periphery of the casing 1, and cooling water is made to circulate through pipe 7 by a mechanical pump or the like (not shown), so as to cool down the hermetically-sealed casing 1 itself, and thus the compressor 2 and the motor 3 are cooled down.

However, this kind of cooling system is so designed as to cool down the outer periphery of the hermetically-sealed casing 1 and further to cool down the compressor 2 and the motor 2 by utilizing the heat transfer effect of the gas inside the casing 1, and therefore it suffers problems, as pointed out heretofore, that a satisfactory cooling efficiency can not always be attained, and consequently, the life of the motor 3 is shortened.

SUMMARY OF THE INVENTION

An object of the present invention, which is contemplated in view of the problems as stated above, is to furnish a helium compressor in which an effective cooling system attached thereto makes it possible to cool down the compressor and the motor effectively and thereby to secure the performances of the motor and the compressor for a long time.

In a helium compressor apparatus wherein the compressor and the motor driving the compressor are disposed in a hermetically-sealed casing and helium gas is used as a refrigerant, the present invention comprises a cooling system attached thereto for forcibly cool down part of the high-pressure gas discharged outside the casing from the compressor and to reintroduce the gas into the casing, so as to attain the above-stated object.

DETAILED DESCRIPTION OF THE PREFERRED EMBODIMENT

Figure 2:
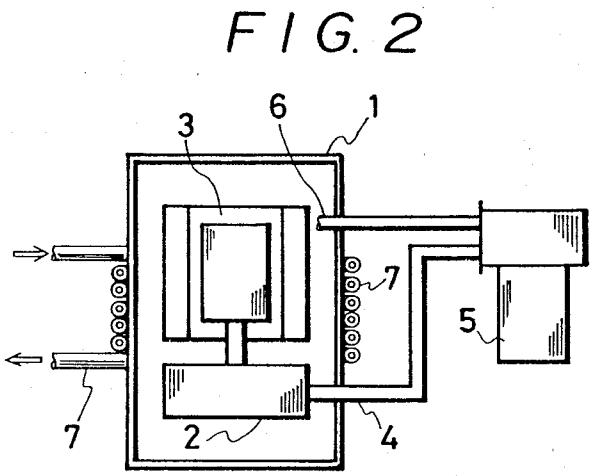
FIG. 2 is an illustration of a construction of a conventional helium compressor.

The following is a detailed description of one embodiment of the helium compressor apparatus of the present invention with reference to the drawing.

Figure 1:
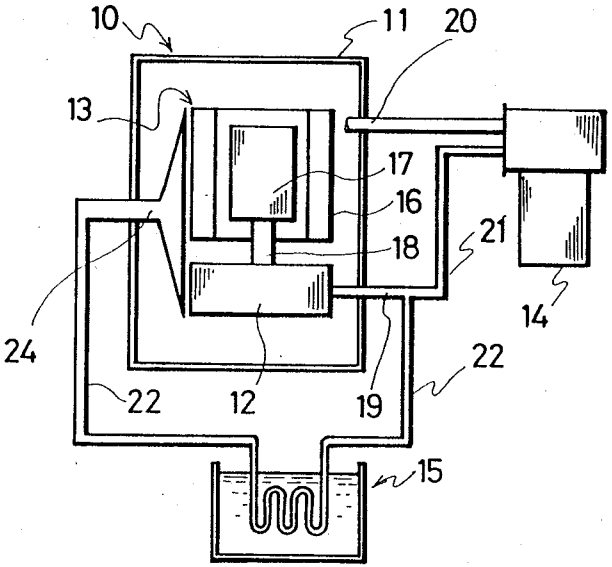
FIG. 1 is an illustration of a construction of a helium compressor of the present invention.

FIG. 1 shows a helium compressor 10 of a vertical type, which is comprised of a compressor 12 and a motor 13 driving compressor 12, both of which are disposed inside a hermetically-sealed casing 11. The helium compressor 10 is equipped with an expansion unit 14 for adiabatically expanding high-pressure gas discharged from the compressor 12, and also is provided, in the present application, a cooling system 15 which forcibly cools down part of the high-pressure gas discharged from the compressor 12 and reintroduces the cooled gas into the casing 11.

The aforesaid motor 13 is comprised of a stator 16 and a rotor 17 and so designed that the rotation of the rotor 17 is transmitted onto the compressor 12 side through the intermediary of a driving shaft 18.

High-pressure gas obtained by the compression of compressor 12 is sent into the expansion unit 14 through a discharge port 19 and expanded adiabatically in expansion unit 14, and thereafter it is collected again into the hermetically-sealed casing 11 through a suction port 20.

In the present embodiment, part of the high-pressure gas is introduced into a cooling pipe 22 which branches from a supply pipe 21 supplying the high-pressure gas to the expansion unit 14. This cooling pipe 22 is laid through a cooling water vessel 15, and the gas passing through the pipe 22 is cooled down thereby into a state of low temperature, and then reintroduced into the hermetically-sealed casing 11 through a cooled gas supply port 24.

The cooled gas circulates smoothly through the cooling pipe 22 under the discharge pressure of the high-pressure gas discharged from the compressor 12 through discharge port 19.

Since the gas which is cooled down to a prescribed temperature by the cooling system 15, 22 can be blown directly onto the compressor 12 and the motor 13, a very large cooling effect can be expected and does occur.

In summary, in the helium compressor of the present invention, as described above, part of the high-pressure gas discharged from the compressor is forcibly cooled down and then reintroduced into the hermetically-sealed casing, and the cooled gas is blown directly onto the compressor and the motor. Therefore, a very high cooling efficiency can be expected in comparison with that of a conventional system comprised of a cooling water pipe which is wound around the outer periphery of the hermetically-sealed casing. Thus, the life of the motor and the compressor is remarkably increased, thereby enabling a long-time continuous operation, and thus a great positive effect is produced in terms of process control.

I claim:

1. A helium compressor apparatus comprising:

a hermetically-sealed casing in which a compressor and a motor driving said compressor are disposed, a supply pipe between said compressor and an expansion unit, to supply high-pressure gas to said expansion unit, and a cooling pipe branched from said supply pipe and connected to a cooling system for cooling a portion of said high-pressure gas, said cooling system having a cooled gas supply port disposed within said hermetically-sealed casing, said helium compressor apparatus cooling down said compressor and said motor in said casing by returning through said cooled gas supply port the portion of the high pressure gas which is forcibly cooled down by said cooling system.

2. The helium compressor apparatus according to claim 1 wherein, said cooling system is a water cooling system.

3. The helium compressor apparatus according to claim 1 wherein, said cooling pipe is connected to a cooling water vessel.

4. A helium compressor apparatus comprising: a hermetically-sealed casing containing a compressor and a motor linked by a drive shaft, said motor driving said compressor; a discharge port which discharges compressed gas from said compressor to a supply pipe, said supply pipe connecting said compressor to an expansion unit; a suction port for returning said gas from said expansion unit to said hermetically-sealed casing; a cooling system for said helium compressor including a cooling pipe branched from said supply pipe and connected to a cooling vessel; a cooled gas supply port disposed within said hermetically-sealed casing and adjacent said compressor and said motor for supplying cooled gas from said cooling vessel to said compressor and said motor to cool down said helium compressor apparatus for efficient operation.

5. Helium compressor means for supplying high-pressure gas to an expansion unit comprising: a gas compressor driven by a motor, said gas compressor and said motor contained within a hermetically-sealed casing: dividing means for dividing compressed gas produced by said compressor between a cooling system and the expansion unit; and means for cooling the portion of compressed gas supplied to said cooling system and returning said cooled portion to a supply port adjacent said gas compressor and said motor.

6. The helium compressor means of claim 5 wherein said motor comprises a rotor surrounded by a stator.

7. The helium compressor means of claim 5 wherein said dividing means comprises a discharge port connected to a branched pipe.

8. The helium compressor means of claim 7 wherein said branched pipe comprises a cooling pipe leading to a cooling system and a supply pipe leading to said expansion unit.

9. The helium compressor means of claim 5 wherein said cooling system comprises a cooling water vessel.

10. The helium compressor means of claim 5 wherein said supply port is located within said hermetically-sealed casing.

11. The helium compressor means of claim 5 wherein a suction port returns said gas from the expansion unit to the hermetically-sealed casing.

12. The helium compressor means of claim 6 wherein a drive shaft links the rotor of said motor to said compressor.

* * * * *